US006446717B1

(12) United States Patent
White et al.

(10) Patent No.: US 6,446,717 B1
(45) Date of Patent: Sep. 10, 2002

(54) CORE-CONTAINING SEALING ASSEMBLY

(75) Inventors: L. Cameron White, Houston; David M. Haugen, League City, both of TX (US); Erik P. Eriksen, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 22 days.

(21) Appl. No.: 09/584,974

(22) Filed: Jun. 1, 2000

(51) Int. Cl.[7] ..... E21B 33/126

(52) U.S. Cl. ..... 166/187; 166/374; 166/383; 166/387

(58) Field of Search ..... 166/196, 179, 166/148, 187, 192, 244.1, 285, 300, 323, 374, 383, 386, 387

(56) References Cited

U.S. PATENT DOCUMENTS

| | | | | |
|---|---|---|---|---|
| 2,306,160 A | | 12/1942 | Freyssinet | 288/6 |
| 2,519,116 A | | 8/1950 | Crake | |
| 2,656,891 A | | 10/1953 | Toelke | |
| 2,814,517 A | | 11/1957 | Razdow | 288/20 |
| 3,147,016 A | | 9/1964 | Traufler | 277/226 |
| 3,690,375 A | | 9/1972 | Shillander | 166/187 |
| 4,078,606 A | | 3/1978 | Montgomery | 166/120 |
| 4,253,676 A | | 3/1981 | Baker et al. | 277/34.6 |
| 4,300,775 A | | 11/1981 | Ringel | 277/34.3 |
| 4,403,660 A | | 9/1983 | Coone | 166/387 |
| 4,406,469 A | | 9/1983 | Allison | 277/123 |
| 4,452,463 A | | 6/1984 | Buckner | 277/120 |
| 4,457,369 A | | 7/1984 | Henderson | 166/125 |
| 4,601,498 A | | 7/1986 | Haugen | 285/332.3 |
| 4,662,450 A | | 5/1987 | Haugen | 166/299 |
| 4,674,570 A | | 6/1987 | Jackson | 166/187 |
| 4,730,670 A | | 3/1988 | Kim | 166/134 |
| 4,762,179 A | | 8/1988 | Wesson et al. | 166/297 |
| 4,886,117 A | * | 12/1989 | Patel | |
| 4,907,651 A | | 3/1990 | Bou-Mikael | 166/114 |
| 4,913,232 A | * | 4/1990 | Cheymol et al. | |
| 5,165,703 A | | 11/1992 | Morvant | 277/188 |
| 5,226,492 A | | 7/1993 | Solaeche et al. | 166/196 |
| 5,271,469 A | * | 12/1993 | Brooks et al. | |
| 5,309,993 A | | 5/1994 | Coon et al. | 166/115 |
| 5,311,938 A | | 5/1994 | Hendrickson et al. | 166/134 |
| 5,511,620 A | | 4/1996 | Baugh et al. | 166/387 |
| 5,605,195 A | | 2/1997 | Eslinger et al. | 166/387 |
| 5,676,384 A | | 10/1997 | Culpepper | 277/188 |
| 5,749,585 A | | 5/1998 | Lembcke | 277/116.2 |
| 5,787,987 A | | 8/1998 | Forsyth et al. | 166/313 |
| 5,803,178 A | | 9/1998 | Cain | 166/306 |
| 5,833,001 A | | 11/1998 | Song et al. | 166/287 |
| 5,875,847 A | | 3/1999 | Forsyth | 166/313 |
| 5,941,313 A | | 8/1999 | Arizmendi | 166/387 |
| 6,009,951 A | | 1/2000 | Coronado et al. | 166/387 |
| 6,041,858 A | | 3/2000 | Arizmendi | 166/187 |

FOREIGN PATENT DOCUMENTS

| | | | |
|---|---|---|---|
| EP | 0 237 662 | 9/1987 | E21B/34/10 |

OTHER PUBLICATIONS

PCT International Search Report from PCT/GB01/02375, Dated Nov. 7, 2001.

* cited by examiner

*Primary Examiner*—Roger Schoeppel
(74) *Attorney, Agent, or Firm*—Moser, Patterson & Sheridan, L.L.P.

(57) ABSTRACT

The invention generally provides a sealing assembly with a deformable portion and a core at least partially disposed within the deformable portion that can be radially expanded to engage an adjacent surface and effect a seal. In one embodiment, the core is a fluid-containing core that preferably comprises a compressible fluid and the deformable portion comprises a deformable metal. The core can retain an amount of stored energy and adjust to changing conditions that otherwise might affect the seal integrity. The core can be sealed within the deformable portion and can be compressed by a force applied to the deformable portion to cause radial expansion. The core can also be coupled to a piston which can apply a force to fluid within the core to cause the radial expansion necessary to effect sealing. An elastomeric member can be attached to the deformable portion to assist in sealing.

18 Claims, 9 Drawing Sheets

CORE-CONTAINING SEALING ASSEMBLY

BACKGROUND OF THE INVENTION

1. Field of the Invention

The present invention relates to an apparatus and method for sealing between two or more surfaces. Specifically, the present invention relates to an expandable packer for sealing oil field wellbores.

2. Background of the Related Art

FIG. 1 is a schematic view of a typical oil field well 10. A wellbore 12 is drilled through the strata 16 and a casing 14 is inserted therein to maintain the integrity of the wellbore for subsequent production of hydrocarbons from beneath the surface of the well. Typically, a replaceable tubing string 18, comprising a plurality of tubes that are longitudinally connected together, is inserted into the casing 14 to a certain depth in the well, such that the lower end of the tubing string is proximate a production zone 20 containing hydrocarbons. Perforations 22 are formed in the casing at the depth of the formation to be produced to allow the hydrocarbons to enter the wellbore 12 through the casing 14. In many cases, it is desirable that the hydrocarbons flow to the surface through the tubing string 18 to avoid corrosion and flow damage to the casing 14. In those cases, a sealing assembly, such as a packer 23, may be run on the lower end of the tubing string 18. The packer 23 seals an annulus between the tubing outside diameter and the casing inside diameter, thereby diverting the hydrocarbons to flow through the tubing to the surface. In other examples, a packer seal is effected inside the tubing string 18 and can be referred to as a plug. Alternatively, the packer may seal an annulus between a smaller tubing string (not shown) outer diameter and the tubing string 18 inner diameter.

FIG. 2 is a schematic cross sectional view of one commercially available permanent type packer 23. The packer is shown in a disengaged state, i.e., "running position", on the left side of the schematic view and in an engaged state, i.e., "set position", on the right side of the view. The packer 23 includes a packer body 24 having a ridge portion 25. A lock ring housing 26 is disposed in an upper portion of the packer 23. A lock ring 43 is disposed between the lock ring housing 26 and the ridge portion 25. The lock ring 43 includes mating ridges 27 adjacent the ridges on the ridge portion 25. At least one upper slip 28 and typically a plurality of slips are disposed below the lock ring housing 26 and include a serrated outer surface where the serrations are typically referred to as wickers 29. The upper slip 28 is disposed about the circumference of the packer 23 and are used to hold the packer in position when the wickers 29 grip the casing 14. An upper cone 30 is disposed below the upper slip 28. The upper cone 30 includes a tapered surface 41 that mates with a corresponding tapered surface on the upper slip 28. The upper cone 30 is used to displace the upper slip 28 radially outward as an axial force is applied to the slip 28 in a direction toward the upper cone. A pair of backup rings 31, 32 is disposed below the upper cone 30 and includes tapered surfaces that allow the backup rings to be displaced toward the casing 14 during "setting" of the packer into a sealing position. A seal ring 33 is disposed below the backup ring 32. A deformable packing element 34 is disposed below the seal ring 33 and is typically an elastomeric material that can be axially compressed and radially expanded toward the casing 14 to effect a seal. A corresponding arrangement of elements is disposed below the packing element 34 as is disposed above the packing element. The arrangement of members below the packing element includes a seal ring 35, a pair of backup rings 36, 37, a lower cone 38 having a tapered surface 42, and a lower slip 39 having wickers 40.

To set the packer 23, mechanical or hydraulic methods can be used and are well known in the art. Regardless of the method used to set the packer, generally the objective is to lower the packer attached to a tubing string to a setting depth and axially compress the assembly of external components relative to the packer body. The axial compression causes at least a portion of the external components, such as the slips 28, 39 and the packing element 34, to expand radially outward into engagement with the casing 14. The lock ring housing 26 and the lock ring 43 are forced along the ridge portion 25 of the packer body 24 as the slips and the packing element are radially expanded. When the desired amount of longitudinal compression is reached, the ridges on the ridge portion 25 in cooperation with the ridges 27 on the lock ring 43 maintain the lock ring and the lock ring housing 26 in the set position. The wickers 29, 40 of the slips 28, 39 "bite" into the casing surface to hold the packer 23 in position.

Elastomeric materials are frequently used for the packing element 34 and other sealing elements because of the resiliency of the elastomeric materials. However, under certain adverse conditions, elastomeric elements may be insufficient for the duty. Adverse conditions such as high temperatures, high pressures, and chemically hostile environments are common in downhole oil field wells that produce hydrocarbons. For example, the temperatures and/or pressures can cause extrusion of elastomeric elements and can result in leakage past the packer after installation. Another problem associated with elastomeric elements is "swab off", where a pressure differential between two surfaces of the elastomeric element, such as the inner and outer surfaces, can deform the element and cause the element to become dislodged from the tool during run-in.

Providing a ductile metal as the packing element has been suggested as one solution to the failure of elastomeric elements. Thus, a "metal to metal" contact is theoretically made between, for example, the packing element and the casing inside diameter that is less prone to extrusion under such adverse circumstances. However, typical manufacturing tolerances of the casing leading to nonconformities, such as the casing ovality, typically reduce the sealing capabilities of the metal to metal contact and leakage can result. Further, even if an initial seal occurs, the seal may leak under changing conditions of temperature and/or pressure, because the metal is not sufficiently resilient.

Prior efforts, such as shown in U.S. Pat. No. 2,519,116, incorporated herein by reference, to effect metal to metal contact have employed detonating explosive charges disposed on a rod within a packer cavity to expand an outer ductile metal wall of the packer. The expanded metal wall engages the casing and forms a metal to metal contact. However, once deformed from the explosion, the cavity is no longer able to expand to meet changing conditions.

Further, U.S. Pat. No. 2,306,160, also incorporated herein by reference, teaches a fluid injected into a cavity to inflate the cavity and effect a seal. The reference discloses that suitable liquid materials injected into the cavity are those liquids which harden after expansion and, thus, are unable to meet changing conditions.

Therefore, there remains a need for a metal sealing assembly with increased sealing capabilities and sufficient resiliency, particularly under adverse conditions in an oil field well.

SUMMARY OF THE INVENTION

The invention generally provides a sealing assembly with a deformable portion and a core at least partially disposed within the deformable portion that can be radially expanded to engage an adjacent surface and effect a seal. In one embodiment, the core is a fluid-containing core that preferably comprises a compressible fluid and the deformable portion comprises a deformable metal. The core can retain an amount of stored energy and adjust to changing conditions that otherwise might affect the seal integrity. The core can be sealed within the deformable portion and can be compressed by a force applied to the deformable portion to cause radial expansion. The core can also be coupled to a piston which can apply a force to fluid within the core to cause the radial expansion necessary to effect sealing. An elastomeric member can be attached to the deformable portion to assist in sealing.

In one aspect, the invention provides a sealing assembly comprising a deformable portion and a fluid-containing core that deforms the deformable portion toward a surface and retains a quantity of stored energy for further deformation. In another aspect, the invention provides a method of sealing between two surfaces comprising positioning a sealing assembly adjacent a surface, increasing a pressure of a fluid in a fluid-containing core in the sealing assembly, deforming a deformable portion of the sealing assembly toward the surface, engaging the surface, and retaining an amount of stored energy in the core after engaging the surface. In another aspect, the invention provides a packer for use in a wellbore comprising a deformable portion and a fluid-containing core within the deformable portion that radially expands the deformable portion in the wellbore. The core can retain stored energy after the radial expansion occurs. In another aspect, the invention provides a sealing assembly comprising a deformable portion and a core that expands the deformable portion toward a surface and retains a quantity of stored energy for further deformation. In another aspect, the invention provides a sealing assembly comprising a deformable portion, a fluid-containing core disposed at least partially within the deformable portion, and a piston in communication with the fluid-containing core.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

The present invention provides a sealing assembly that can seal against an adjacent surface using deformable materials, such as deformable metal, with a core disposed within the sealing assembly. The invention can be used as a packer downhole in an oil field well and the embodiments described herein relate to such use, although it should be understood that the invention can be used in other applications and is not limited to the exemplary embodiments shown and described.

Figure 2:
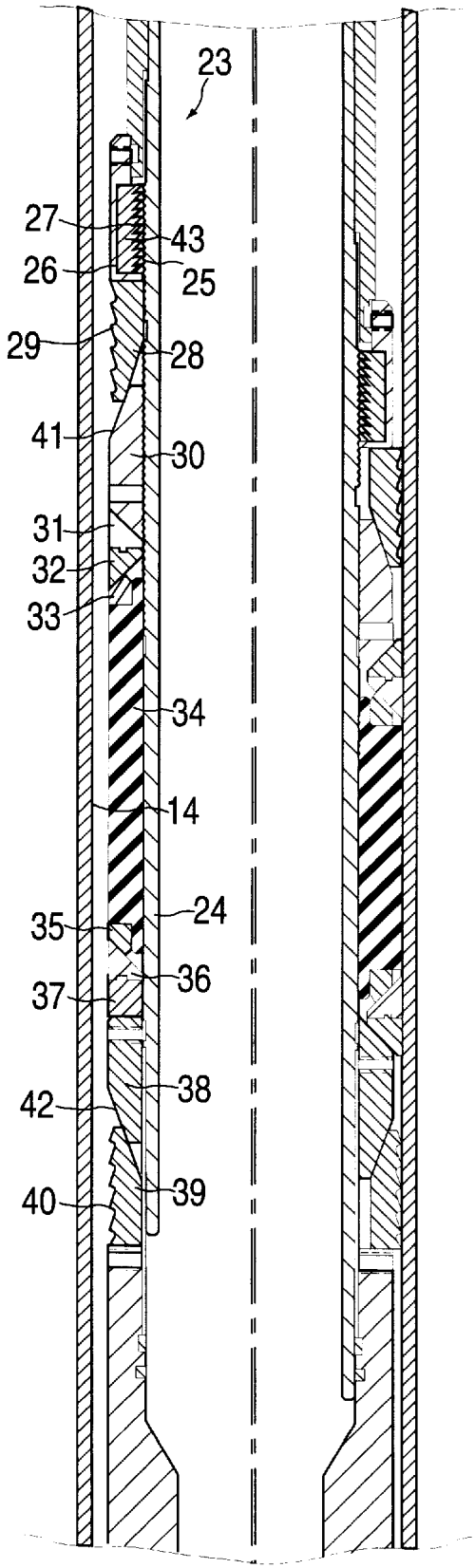
FIG. 2 PRIOR ART
FIG. 2 is a schematic cross sectional view of a typical packer.
Figure 3:
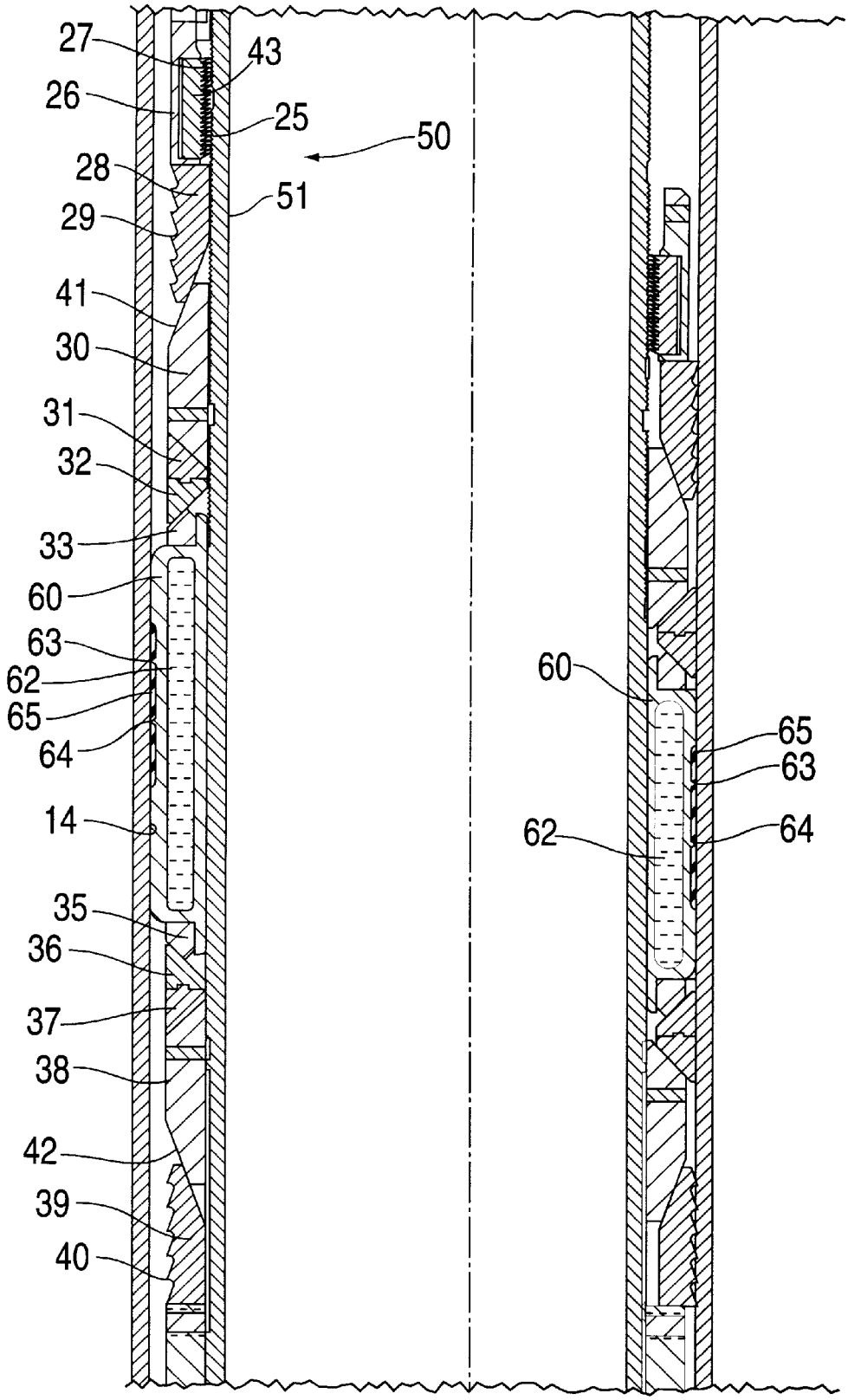
FIG. 3 is a schematic cross sectional view of a sealing assembly.

FIG. 3 is a schematic cross sectional view of a sealing assembly 50 of the invention, such as a packer. The sealing assembly 50 is shown in a running position on the left side of the schematic view and in a set position on the right side of the view. Generally, in this embodiment, the sealing assembly 50 can include various components surrounding a sealing assembly body 51, such as described in reference to the components shown in FIG. 2 with the components being similarly numbered. The embodiment shown in FIG. 3 shows a deformable portion 60 that is disposed generally between the slips 28, 39 and is described in reference to FIG. 4.

Figure 4:
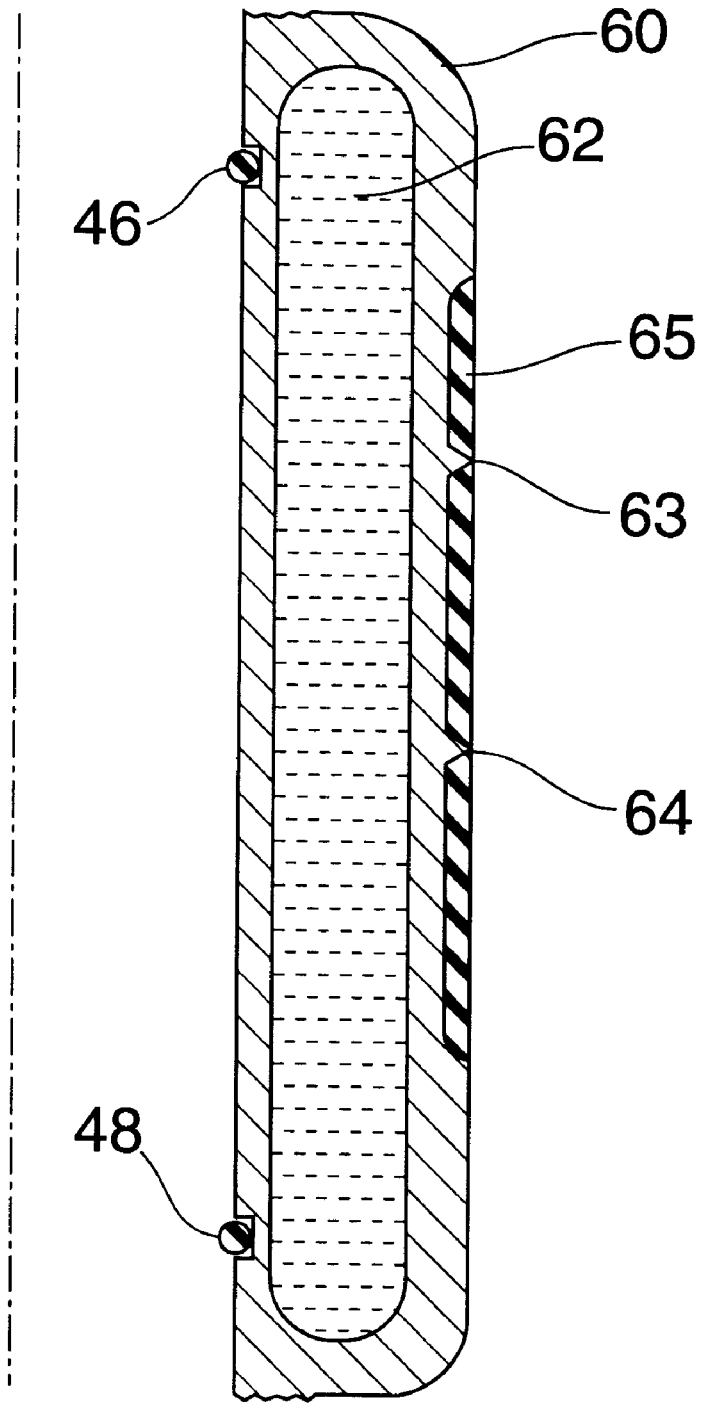
FIG. 4 is a detail schematic view of a deformable portion shown in FIG. 3.

FIG. 4 is a detail schematic view of the deformable portion 60. The deformable portion 60 is dimensioned to expand outward toward the casing or other adjacent structure upon axial compression of the core 62 so that the portion 60 engages the casing 14. The deformable portion 60 can be a metal including metallic substances, such as ductile iron, stainless steel, or a composite, such as a polymer matrix composite or metal matrix composite. Other materials could be high strength polymers, such as polyetheretherketone (PEEK), polyether-ketone and polyamide-imide. In other embodiments, the deformable portion could be disposed radially inward of the packer and effect an inwardly directed seal. For instance, a pipe disposed through an internal portion of the packer can be sealed about the outside diameter of the pipe with a inwardly directed deformable portion.

The core 62 contains a fluid in at least one embodiment. The fluid may be liquid or gaseous, or a combination thereof. The fluids can include a variety of gases, such as nitrogen, argon, carbon dioxide, and other gases, and/or can be a variety of liquids, such as relatively compressible liquids, where silicone oil is one example. Liquids as used herein include gels. The fluid can also include a solid that becomes a fluid at the operating conditions surrounding the sealing assembly 50, including, for example, a solid having a low melting temperature. The fluid can also be formed from gases created from a chemically activated reaction between two or more substances. The fluid in the core 62 can also be expanded by a timed or temperature activation with or without a controller, described more fully in reference to FIG. 6.

Preferably, the fluid, or combination of fluids, is compressible to create a potential or stored energy in a compressed state. While liquids are typically considered incompressible, liquids exhibit compressible characteristics depending on the pressure or force exerted on the fluid.

Figure 1:
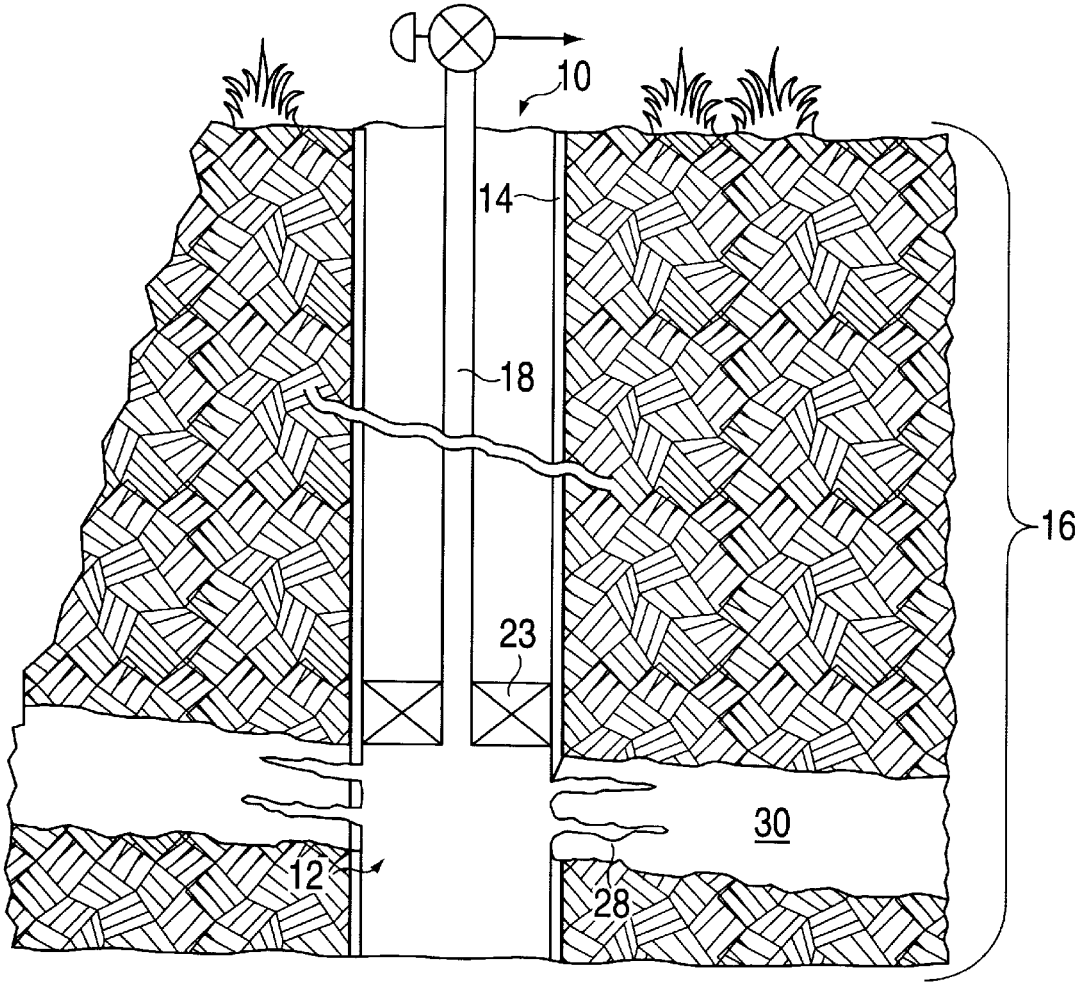
FIG. 1 PRIOR ART
FIG. 1 is a schematic view of a typical downhole well having at least one packer.

Further, some liquids are more compressible than other liquids. For example, silicone oil, used in the oil field industry, is known to be several times more compressible than water and, thus, would have a greater stored energy at a given compressive force. In a compressed condition, the liquid retains an amount of stored potential energy that can be released to further expand the deformable portion after the initial expansion of the metal, should conditions change that affect the seal integrity between the sealing assembly and adjacent surface. Furthermore, when the core contains a compressible gaseous portion, the compressed gases can also store a quantity of energy that can likewise be used to further expand the deformable portion. The deformable portion can also contract if necessary, thereby compressing the fluid in the core, due to changing conditions in the wellbore 12, tubing string 18 (shown in FIG. 1) and/or other components that can affect the seal.

An additional seal can be established by compressing an elastomeric member 65, such as a rubber-containing compound, with the deformable portion 60 against the casing 14. The elastomeric member 65 can be bonded or otherwise attached to the deformable portion 60. The term "elastomeric" is broadly defined and can include other deformable materials that exhibit some resiliency after compression. If an elastomeric member is used, preferably the elastomeric material is at least partially disposed between various deformable portions which engage the casing, thus, "trapping" the elastomeric member therebetween. For instance, the elastomeric member 65 can be disposed longitudinally between ridges 63 and 64. When the ridges are expanded toward the casing 14, at least a portion of the elastomeric member 65 is disposed radially between the casing and the deformed metal, and longitudinally between the ridges. The longitudinal extrusion of the elastomeric member is thus minimized.

The size of the core 62 varies depending on the needed expansion of the deformable portion 60. For example, the sealing assembly 50 with the core can be a production packer that typically is a substantially permanent packer disposed adjacent or between production zones in a production well and engages a tubing string and the casing. The sealing assembly can be also be a liner top packer that is used to "pack off" an annulus between a casing and a liner. A liner top packer typically has a greater expansion need compared to the production packer, due to greater distances between a liner and a casing. The sealing assembly can also be a service packer that is used to temporarily isolate zones of a production well to perform maintenance on the well and thus is designed to be removable. Plugs and other seals can also use the expandable sealing assembly.

Further, the interface between the body 51, shown in FIG. 3, and the deformable portion 60 can be sealed with seals 46, 48, such as O-rings. Corresponding grooves in either the body or the deformable portion can be formed to support the seals.

Figure 5:
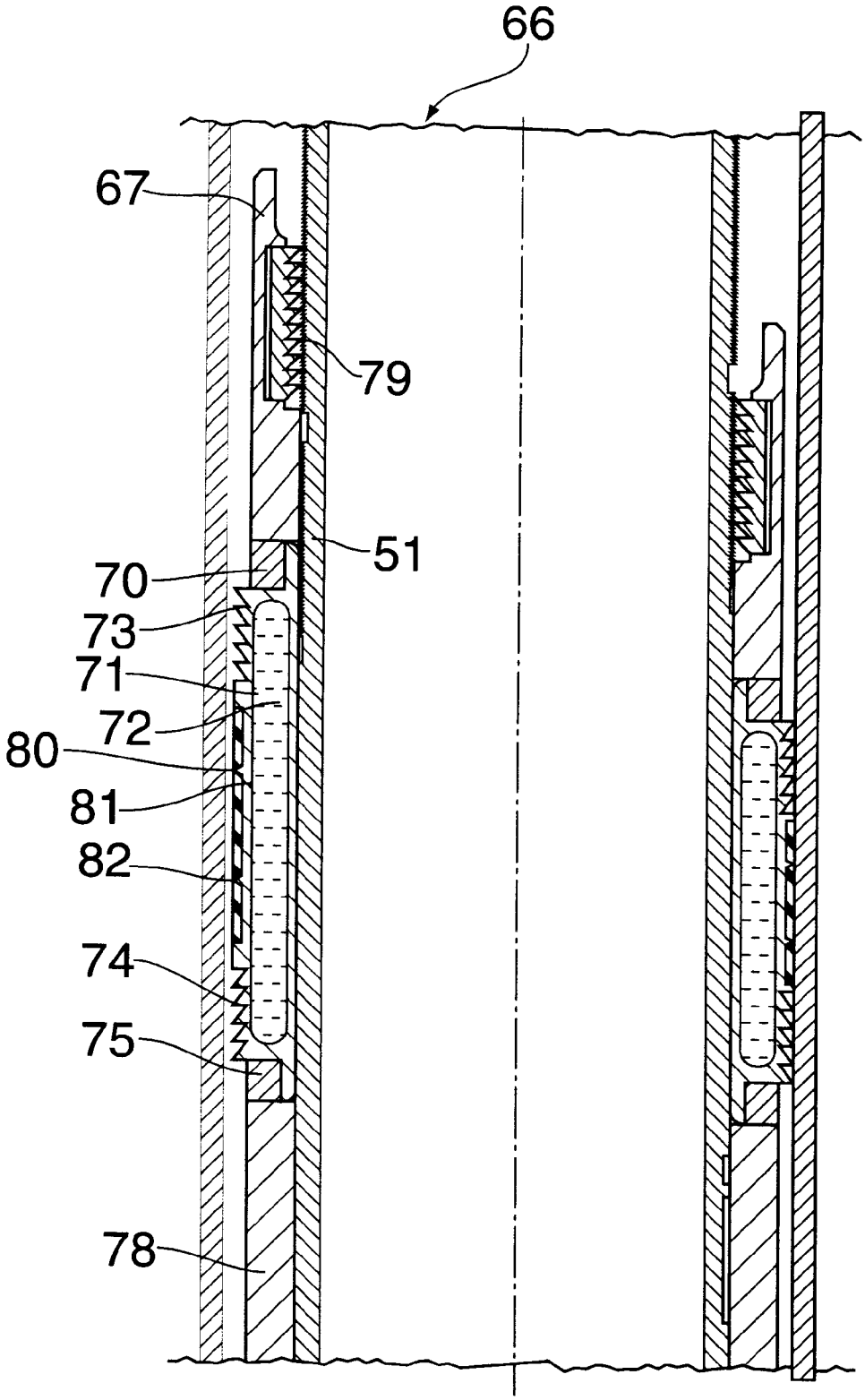
FIG. 5 is a schematic cross sectional view of an alternative embodiment of a sealing assembly.

In some embodiments, the slips 28, 39 with associated gripping surfaces can be included with the deformable portion 60, in FIGS. 3 and 4. FIG. 5 is a schematic cross sectional view of such an alternative embodiment of a sealing assembly 66. The sealing assembly 66 includes a sealing assembly body 51 disposed along a tubing string or liner (shown in FIG. 1) or near the end of the tubing string. A lock ring housing 67 is disposed at an upper end of the sealing assembly body 51 and is coupled to a lock ring 79. The lock ring 79 has ridges, similar to ridges 27 shown in FIG. 3, and engages ridges on a ridge portion of the sealing assembly body 51. In this embodiment, an upper retainer ring 70 is disposed below the lock ring housing 67 and above a deformable portion 71. The deformable portion 71 includes a core 72, similar to the core 62, shown in FIG. 3. Gripping surfaces 73, 74 are disposed on the deformable portion 71 and face the inside surface of the casing 14. Alternatively, the gripping surfaces 73, 74 could be separate members disposed adjacent the deformable portion 71. A lower retainer ring 75 is disposed below the deformable portion 71 and a lower support 78 is disposed below the ring 75 to support the ring longitudinally along the sealing assembly 66. An elastomeric member 81, disposed longitudinally between ridges 80 and 82 is coupled to the exterior surface of the deformable portion 71.

When the sealing assembly body 51 is held in place and the lock ring housing 67 is pushed down, the lock ring 79 is moved down toward the lower support 78, which compresses the various parts disposed therebetween. The movement also axially compresses the deformable portion 71 and the core 72, so that the deformable portion expands radially toward the casing 14 or other adjacent surfaces. The gripping surfaces 73, 74 also expand radially and engage the casing 14 as the deformable portion 71 expands radially, thereby fixing the sealing assembly in position.

Figure 6:
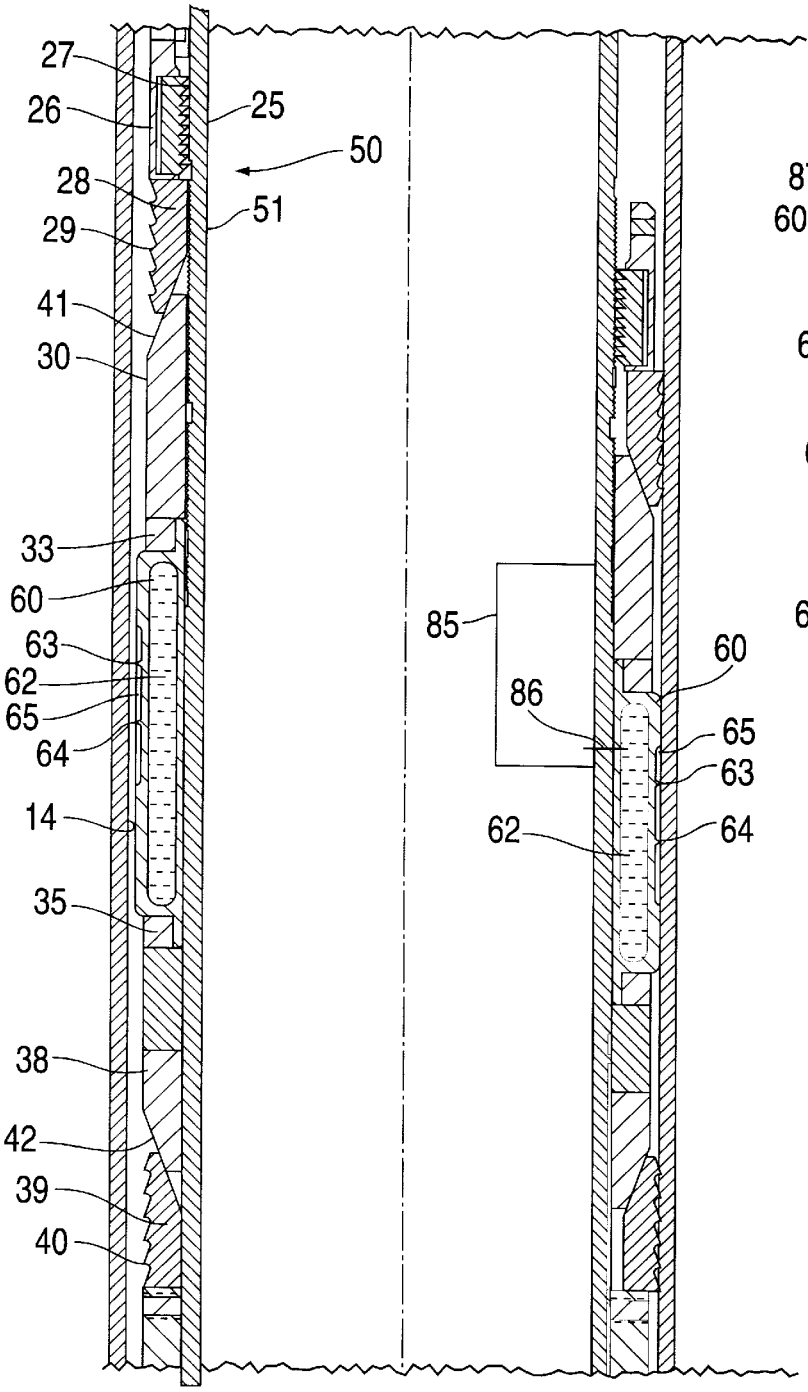
FIG. 6 is a schematic cross sectional view of an alternative embodiment of a sealing assembly.

FIG. 6 is a schematic cross sectional view of an alternative embodiment of the sealing assembly. Similar elements as shown in FIGS. 3–5 are similarly numbered and have been described above. In the embodiment shown in FIG. 6, the upper cone 30 and the lower cone 38 may extend to the seal rings 33, 35 respectively. The sealing assembly 50 includes a controller 85, shown schematically, that can be coupled to the core 62, such as through a connection 86, such as a pneumatic, electrical or hydraulic connection. The controller 85 can be located on the inside of the sealing assembly body 51, at remote locations such as the well surface or downhole near other equipment or other locations as appropriate. The controller 85 can also be located within the core 62. The controller 85 can control the expansion of the core 62 and thus the expansion of the deformable portion 60. The connection 86 can be an electrical wire, a conduit for transmission of liquids, chemicals, gases, or other activating elements through which the core 62 is activated to expand. Without limitation and as merely one example, the controller can include a timer that activates an electrical charge to the core 62. The core 62 can contain an electrically sensitive material that changes upon electrical stimulation to produce a compressible fluid, such as a gas, in the core 62 as described herein, for example, electrically thixotropic materials. As another example, the controller can receive remote signals through acoustic, electrical or pressure transmission to actuate the core 62. The controller 85 can also receive signals directly, for example, from a wireline instrument inserted downhole and coupled to the controller. The controller 85 can also provide pneumatic or hydraulic pressure into the core 62 to expand or contract the core through the connection 86.

Figure 7:
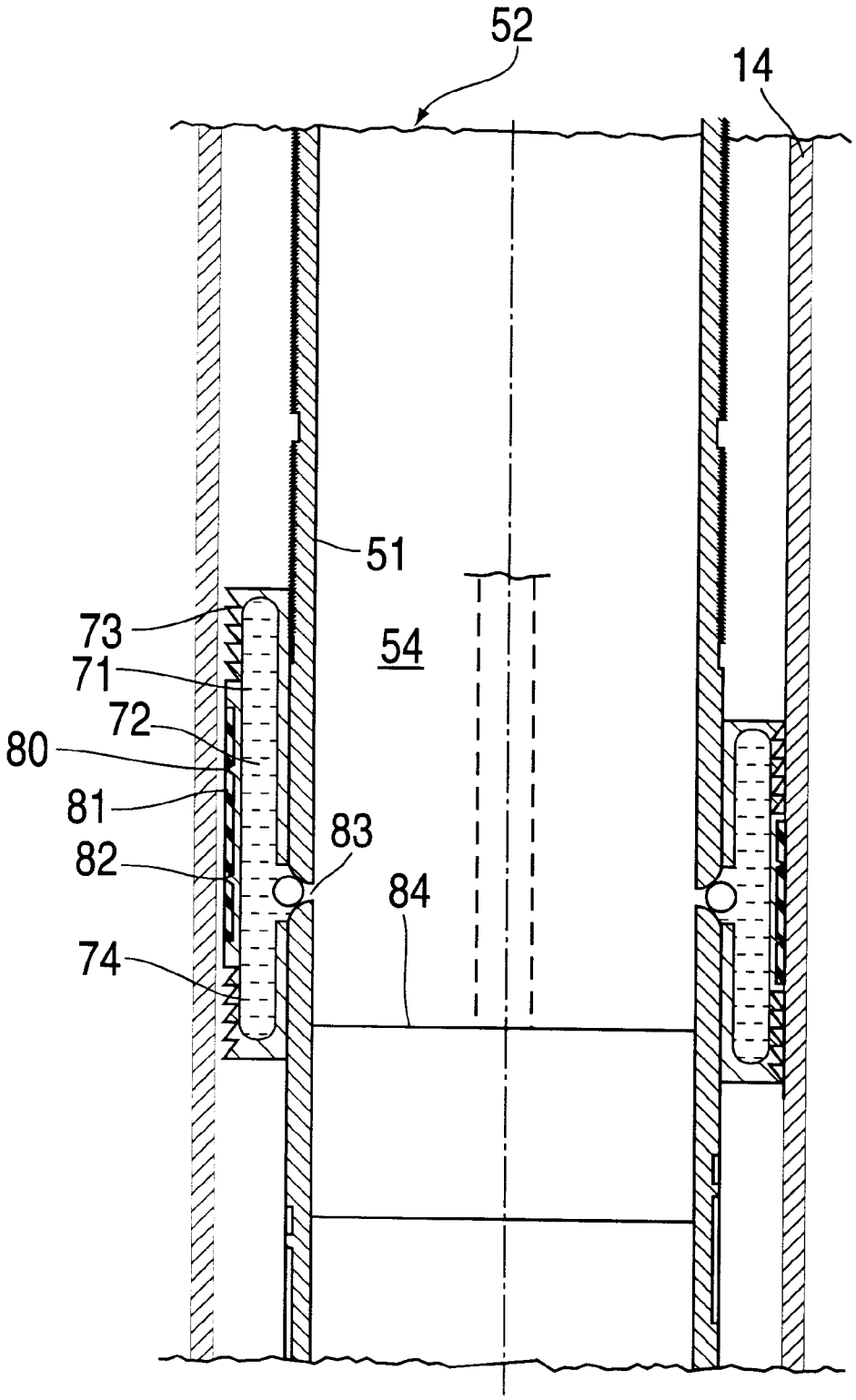
FIG. 7 is a schematic cross sectional view of an alternative embodiment of a sealing assembly.

FIG. 7 is a schematic cross sectional view of another embodiment of a sealing assembly 52. Similar elements, shown in FIGS. 3–6, are similarly numbered and have been described above. While the gripping surfaces 73, 74 are shown coupled to the deformable portion 71, it is understood that the gripping portions can be separate or can be similar to the slips shown in FIGS. 3 and 6. In some embodiments, the gripping portions may not be used at all. The embodiment shown in FIG. 7 includes one or more flow members 83, such as a check valve, disposed between the core 72 and internal bore 54 of the sealing assembly 52. The check valve allows fluid in the internal bore of the sealing assembly to flow into the core 72 and restrict the flow of the fluid out of the core 72. In some embodiments, the flow member 83 could be a solenoid actuated valve that opens and closes upon activation. In other embodiments, the flow member could simply be a port to allow fluid into and out of the core 72.

As merely one example of an operation using the embodiment shown in FIG. 7, the sealing assembly 52, such a packer, could be positioned downhole inside a casing of a wellbore. An internal sealing assembly 84, such as a plug, could be inserted downhole with the use of a wireline instrument (shown schematically in dashed lines) and seal the inside bore 54 of the packer. Fluid could be pumped downhole through tubing 18 attached to the packer. The fluid could flow though the flow member 83, into the core 72, and expand the deformable portion 71 toward the casing 14. The flow member 83 could restrict backflow of the fluid from the core 72 into the internal bore 54 to maintain a pressure in the core when the plug is removed. Alternatively, the fluid could be contained in a conduit, such as a hydraulic line, and delivered to the core 72.

Figure 8:
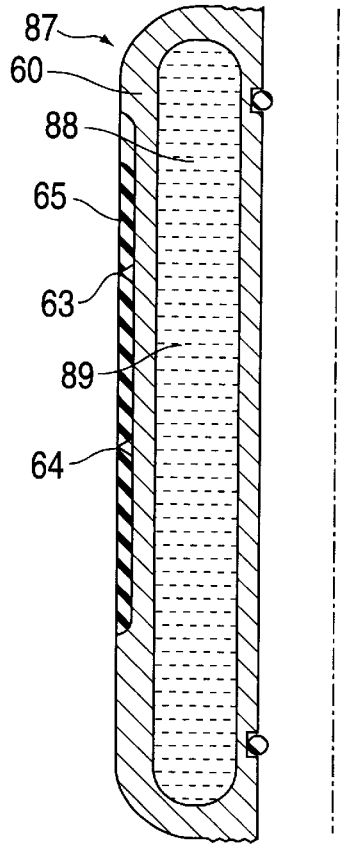
FIG. 8 is a schematic cross sectional view of an alternative embodiment of a sealing assembly.

FIG. 8 is a schematic cross sectional view of a sealing assembly 87. Similar elements are similarly numbered as those elements shown and described in FIGS. 3–7. In the embodiment shown in FIG. 8, a core 88 includes a material 89 that expands radially and still retains stored energy for further expansion and contraction. The material 89 can include, without limitation, expandable foam. The expansion of the foam can be activated downhole by a controller, such as the controller 85, shown in FIG. 6. The material 89 can include various elastomeric materials that likewise can be radially expanded toward an adjacent surface, such as a casing 14, shown in FIG. 6.

The material 89 can also include various shape memory alloys that can have an original shape under a first condition, be deformed to a second shape under a second condition, and then return to the original shape when the first condition is reestablished. Some shape memory alloys are temperature dependent and will return to a given shape based upon the reestablishment of a given temperature. Shape memory alloys include, for example, nickel/titanium alloys, such as "NITINOL™", and certain two phase brass alloys. As one example, in the core 88, the shape memory alloy material can be shaped to a compressed shape at a given condition, such as a first temperature, and an expanded shape at another condition, such as an elevated second temperature. The temperature of the memory material can kept temporarily lower than the second temperature as the sealing element 87 is inserted downhole to an appropriate location. Then, the temperature of the core can be raised to the second temperature, so that the core expands.

Figure 9:
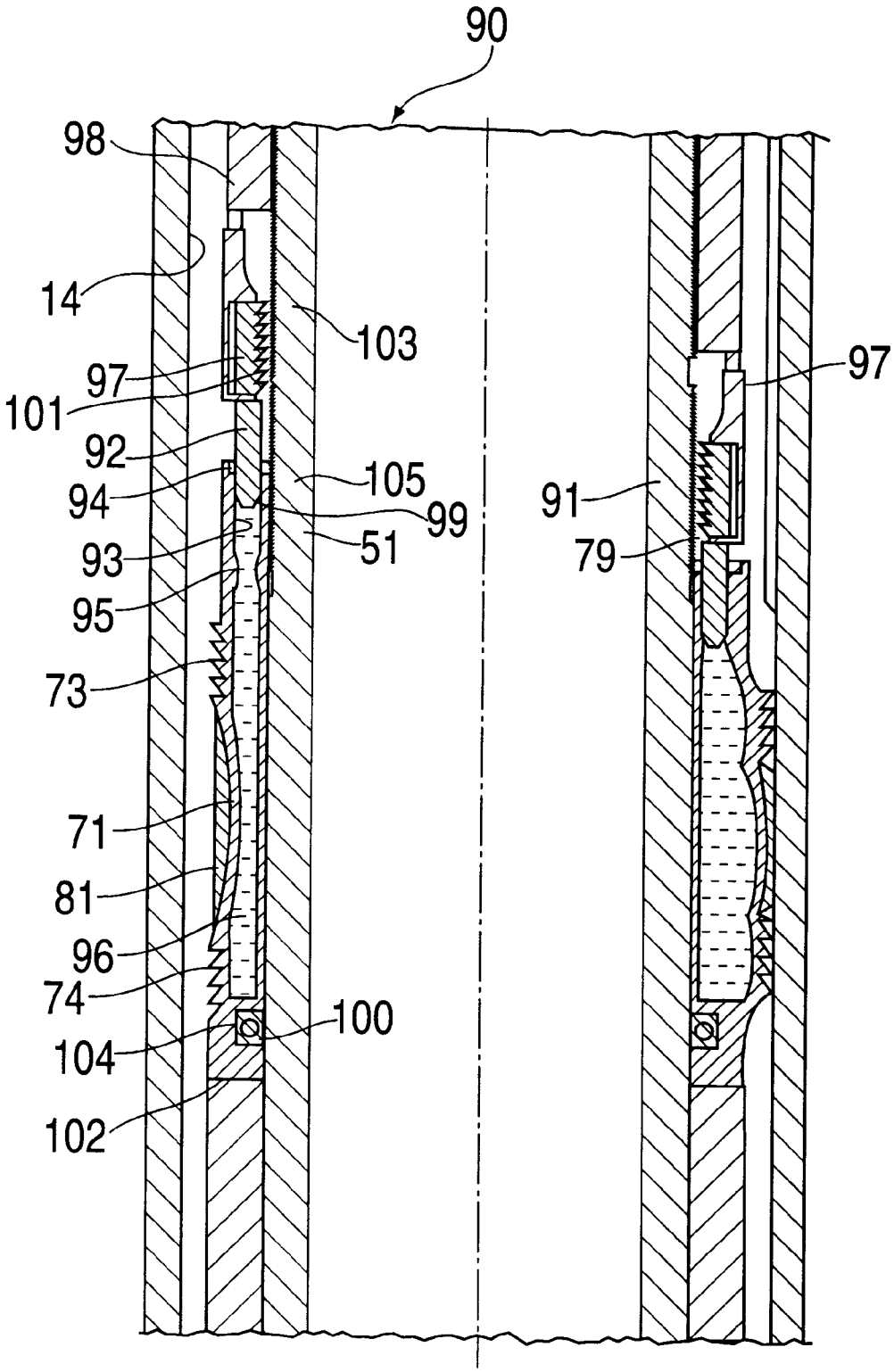
FIG. 9 is a schematic cross sectional view of an alternative embodiment of a sealing assembly.

FIG. 9 is a schematic cross sectional view of an alternative embodiment of a sealing assembly 90 having a piston in communication with fluid in the core. FIG. 9 shows the sealing assembly 90 disengaged with an adjacent surface on the left side of the figure and engaged on the right side. Elements similar to FIGS. 3–8 are similarly numbered. The sealing assembly 90 includes a sealing assembly body 91 disposed between tubing joints, similar to the sealing assembly body 51, shown in FIGS. 3–7. An actuator 98 is disposed adjacent the sealing assembly body 91 and is used to axially move the components of the sealing assembly 90 by mechanical, hydraulic, electrical, chemical or other modes well known in the art. The actuator 98 can be remotely controlled or directly controlled through, for example, a wireline inserted downhole. The actuator can be activated similar to the activation of controller 85, shown in FIG. 6. A lock ring housing 97 that includes ridges 101 is disposed below the actuator 98 and is engaged to a lock ring 103 having ridges. The lock ring 103 is engaged with corresponding ridges on a ridge portion 105 of the sealing assembly body 91 and assists in locking the lock ring housing 97 in position when the sealing assembly 90 is "set". The lock ring housing 97 is coupled to one or more pistons 92 that engage a deformable portion 71. The deformable portion 71 is disposed about the sealing assembly body 91 and includes a fluid-containing core 96 formed therein. The piston 92 is disposed at least partially in a channel 93 of the sealing assembly 90 where the channel 93 is coupled to the core 96. The channel 93 can include a constricted portion 95 to receive a tapered portion 99 of the piston 92. One or more annular seals 94 are disposed around the piston 92 and assist in retaining fluid in the core 96 from leaking past the piston 92. The piston 92 can have a variety of shapes, such as a concentric piston disposed in a circular channel 93. An elastomeric member 81 can be attached to the outer surface of the deformable portion 71 and assists in resiliently engaging the casing 14 when the sealing assembly is "set." A lower portion of the deformable portion 71 abuts a shoulder 102 in the sealing assembly body 91. A slot 104 is formed between the deformable portion 71 and the sealing assembly body 91. A seal 100 is disposed in the slot 104 and seals between the deformable portion 71 and the sealing assembly 91. Gripping surfaces 73, 74 are optionally included with the sealing assembly 90 and can engage an adjacent surface, such as the casing 14, by expanding the core 71, as described herein. Alternatively, separate slips with gripping surfaces can be used, such as shown in FIGS. 3 and 6.

In operation, the actuator 98 can use mechanical forces to "set" the sealing assembly 90 by forcing the lock ring housing 97 downward toward the piston 92. The lock ring housing 97 moves axially and presses the piston 92 toward the core 96, thereby increasing pressure in the core. The deformable portion 71 can be relatively thin adjacent the core 96 and relatively thick on either end from the core. The deformable material adjacent the core deforms from the increased core pressure and radially expands the deformable portion 71 toward the casing 14. In this embodiment, the elastomeric member 81 is pressed against the casing 14 by the deformable portion 71 to assist in sealing against the casing. Similarly, the gripping surfaces 73, 74 are engaged with the casing 14 to longitudinally secure the sealing assembly 90 in position. The piston 92 can be displaced along the channel 93 until the piston engages the constricted portion 95 in the channel, whereupon the piston lodges in position and seals the channel 93. Further, the lock ring housing 97 and lock ring 103 engage the ridge portion 105 of the sealing assembly body 91 and longitudinally fix the piston in the channel 93. Alternatively, the piston 92 can be spring-biased in the channel and "float" to compensate for changes in the pressure of the core 96.

Other variations of the embodiments shown in FIG. 9 and other figures are possible. For example, the actuator 98 can be disposed below the lock ring housing 97. The lock ring housing 97 can directly contact the ridge portion 105 of the sealing assembly body 91 without the lock ring 103. Alternatively, the actuator can be a remote power source, such as a hydraulic cylinder, incorporating the piston 92 therein for pressurizing a fluid in communication with the fluid in the core 96 for expansion thereof. Slips, retainer rings, backup rings, and seal rings can also be used, such as described in reference to FIGS. 3 and 6. Further, the piston 92 can be an annular piston surrounding the sealing assembly body 91 and disposed in an annular channel.

Figure 10:
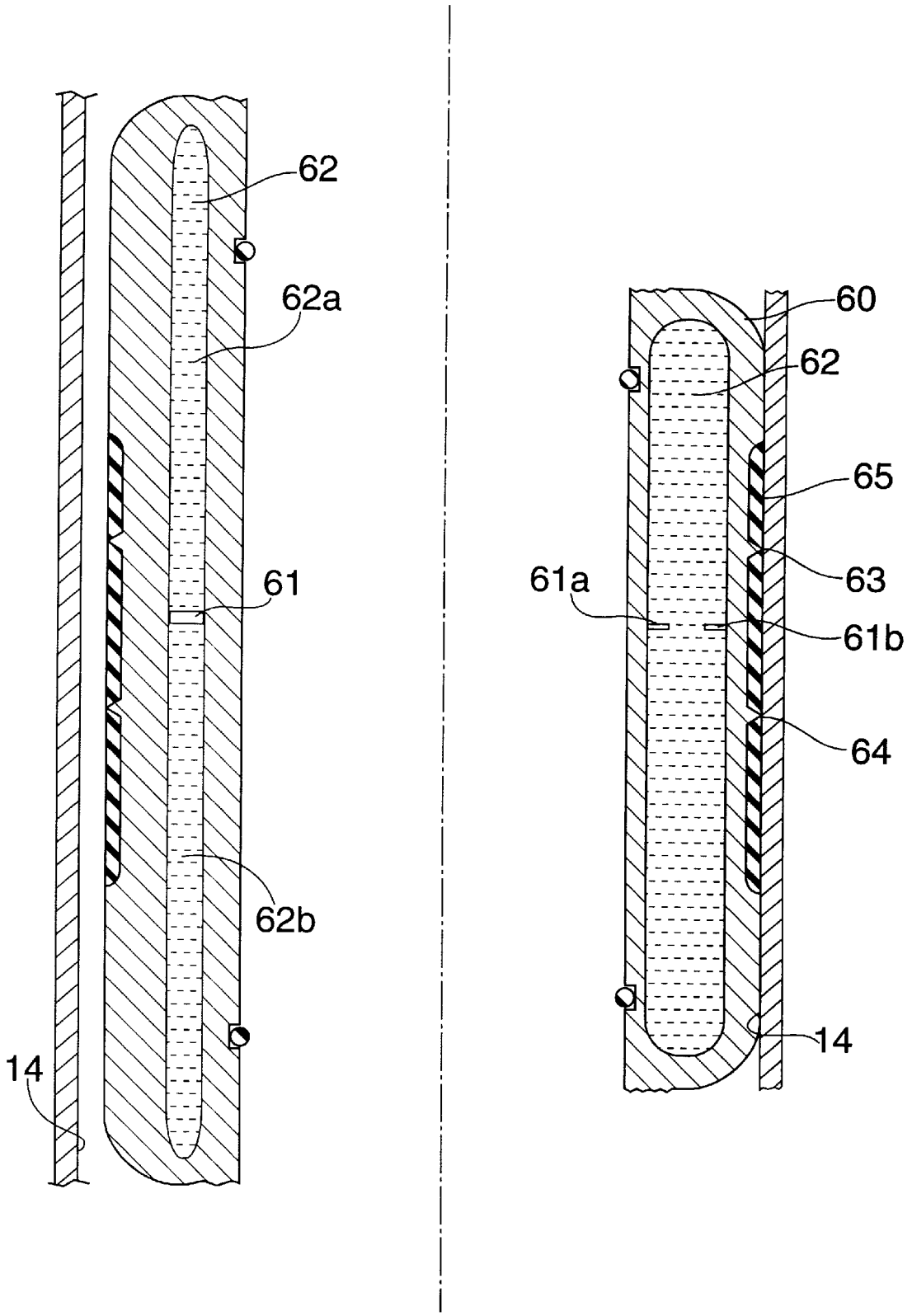
FIG. 10 is a detail schematic view of an alternative embodiment of a core.

FIG. 10 is a detail schematic view of an alternative embodiment of a core, such as the core 62 shown in FIG. 3, although the core can be used in various other embodiments described herein. FIG. 10 shows a core 62 disengaged from an adjacent surface on the left side of the figure and engaged on the right side. Elements similar to FIG. 3 are similarly numbered. The core 62 includes two or more compartments 62*a*, 62*b*. Compartment 62*a* contains a first chemically reactive fluid and compartment 62*b* contains a second chemically reactive fluid. The compartments are fluidicly separated by a separable member 61. The chemically reactive fluids react to form an expansive mixture when mixed together that is greater than the volume of the sum of the fluids in an unreacted state. The separable member 61 can be a flexible membrane stretched across the core, a brittle material or other materials. Regardless of the material, the separable member 61 generally seals the compartments from each other when the core is uncompressed.

In operation, the core is compressed generally axially and expands radially. As the distance between the walls of the core lengthens from the radially expansion, the separable member 61 is placed in tension and breaks or tears away or otherwise separates from the wall or walls or the member itself separates into two or more portions 61*a*, 61*b*. The displaced member 61 allows the chemically reactive fluids to mix which causes an increased volume and/or pressure. The core 62 expands generally radially and engages the casing 14 or other adjacent surface. The quantity of the chemically reactive fluids when mixed can be sufficient to provide an amount of stored energy within the core after the core has expanded against the casing.

Variations in the orientation of the sealing assembly, slip(s), seal(s), cone(s), packer, elastomeric member(s), core (s), and other components are also possible. Further, while the sealing assembly is preferably used as a packer, it is understood that the embodiment(s) of a packer is exemplary. The invention may be used in a variety of sealing applications. Further, actuation of the packer and/or sealing assembly can vary and can include mechanical, hydraulic, chemical, or other types of actuation. Additionally, all movements and positions, such as "inside", "outside", "radially", "longitudinally" and "axially", described herein are relative and accordingly, it is contemplated by the present invention to orient any or all of the components to achieve the desired movement of the deformable portion against surfaces whether in a direction inwardly or outwardly, radially, longitudinally or axially. For example, the expansion radially can be either outward to a larger circumference or inward toward a smaller inner circumference of an annular hole. Furthermore, while embodiments are shown that compress axially and expand radially, it is understood that other directions could be used and be within the scope of the invention, such as but not limited to, compression radially and expansion axially or compression at an angle and expansion radially and/or axially.

While foregoing is directed to the preferred embodiment of the present invention, other and further embodiments of the invention may be devised without departing from the basic scope thereof, and the scope thereof is determined by the claims that follow.

What is claimed is:

1. A sealing assembly for use in a wellbore, comprising a) a deformable portion; and b) a fluid core comprising a relatively compressible fluid substantially enclosed within the deformable portion, the deformable portion to be initially deformed into contact with one or more adjacent surfaces within said wellbore, and the fluid core subsequently having sufficient stored energy to deform the deformable portion.

2. The sealing assembly of claim 1, wherein the sealing assembly further comprises a packer.

3. The sealing assembly of claim 1, wherein the deformable portion comprises a metal.

4. The sealing assembly of claim 1, wherein the fluid comprises a liquid portion and a gaseous portion.

5. The sealing assembly of claim 1, wherein the deformable portion expands in a radial direction under an axial force applied substantially perpendicular to the radial direction.

6. The sealing assembly of claim 2, wherein the packer further comprises an elastomer member attached to the deformable portion.

7. The sealing assembly of claim 1, wherein the sealing assembly further comprises an annular shape, and the deformable portion expands primarily radially inward from the sealing assembly.

8. The sealing assembly of claim 1, wherein the sealing assembly further comprises an annular shape, and the deformable portion expands primarily radially outward from the sealing assembly.

9. The sealing assembly of claim 1, wherein the core is sealed in the deformable portion.

10. The sealing assembly of claim 1, further comprising a piston in communication with the core for pressurizing the fluid.

11. The sealing assembly of claim 1, further comprising a piston at least partially disposed in the core.

12. The sealing assembly of claim 11, wherein the piston is annularly shaped and axially aligned with the core.

13. The sealing assembly of claim 11, further comprising an actuator that moves the piston toward the core to increase the pressure of the fluid.

14. The sealing assembly of claim 13, further comprising a controller connected to the actuator.

15. The sealing assembly of claim 11, further comprising a seal disposed about the piston.

16. The sealing assembly of claim 1, wherein the core contains a quantity of stored energy.

17. The sealing assembly of claim 1, wherein the core is sufficiently resilient for further reformation.

18. The sealing assembly of claim 1, wherein the core comprises a shape memory material.

* * * * *